US010058223B2

(12) United States Patent
Zimmer

(10) Patent No.: US 10,058,223 B2
(45) Date of Patent: Aug. 28, 2018

(54) CRACK AND CREVICE CLEANING TOOLS AND ATTACHMENTS THEREFOR

(71) Applicant: Edward A. Zimmer, Defiance, OH (US)

(72) Inventor: Edward A. Zimmer, Defiance, OH (US)

( * ) Notice: Subject to any disclaimer, the term of this patent is extended or adjusted under 35 U.S.C. 154(b) by 0 days.

(21) Appl. No.: 14/713,490

(22) Filed: May 15, 2015

(65) Prior Publication Data

US 2015/0342428 A1 Dec. 3, 2015

Related U.S. Application Data

(60) Provisional application No. 61/994,304, filed on May 16, 2014, provisional application No. 62/118,725, filed on Feb. 20, 2015.

(51) Int. Cl.

| | |
|---|---|
| ***A47L 9/02*** | (2006.01) |
| ***E01H 1/08*** | (2006.01) |
| *A47L 9/06* | (2006.01) |

(52) U.S. Cl.

CPC ..... *A47L 9/02* (2013.01); *E01H 1/0845* (2013.01); *A47L 9/06* (2013.01)

(58) Field of Classification Search

CPC ..... A47L 9/02; A47L 9/066; E01H 1/0845
IPC ..... A47L 9/02
See application file for complete search history.

(56) References Cited

U.S. PATENT DOCUMENTS

| | | | | |
|---|---|---|---|---|
| 8,650,700 | B1 * | 2/2014 | Burns, Jr. | E01H 1/08 15/246 |
| 2008/0256737 | A1 * | 10/2008 | Ruston | A47L 9/02 15/236.01 |
| 2012/0234412 | A1 * | 9/2012 | Prager | E01H 1/0809 137/565.01 |

FOREIGN PATENT DOCUMENTS

| | | | |
|---|---|---|---|
| AU | 9516588 | * | 4/1995 |

* cited by examiner

*Primary Examiner* — David Redding
(74) *Attorney, Agent, or Firm* — Marshall & Melhorn, LLC

(57) ABSTRACT

A crack and crevice cleaning tool has a portion of circular cross section for attachment to a source of vacuum such as a vacuum cleaner, and a flattened nozzle portion for placement next to a crack or crevice and guide means mounted at the end of the nozzle portion and insertable in the crack or crevice being cleaned to guide the tool.

3 Claims, 4 Drawing Sheets

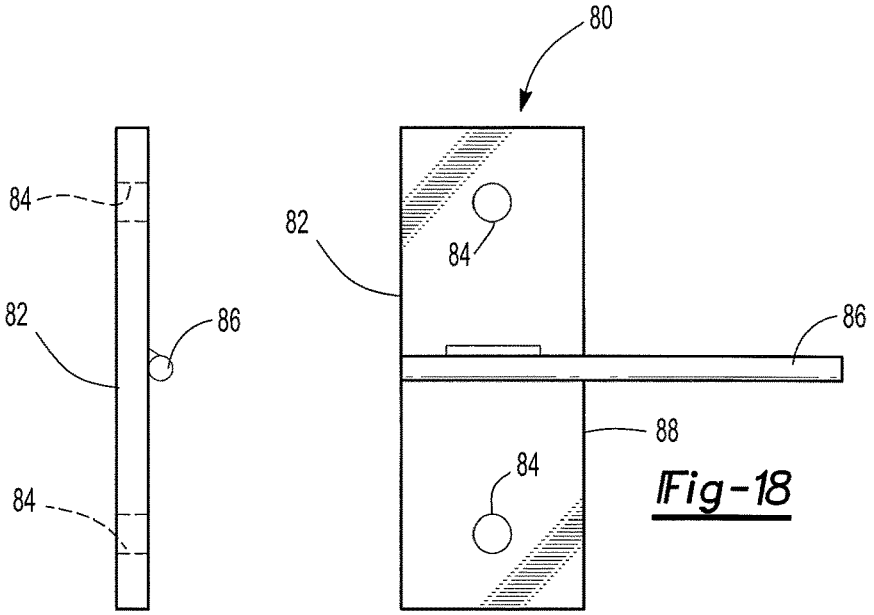
Fig-18
Fig-19
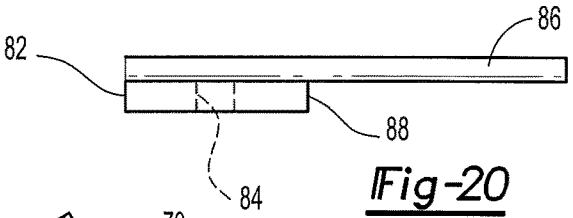
Fig-20
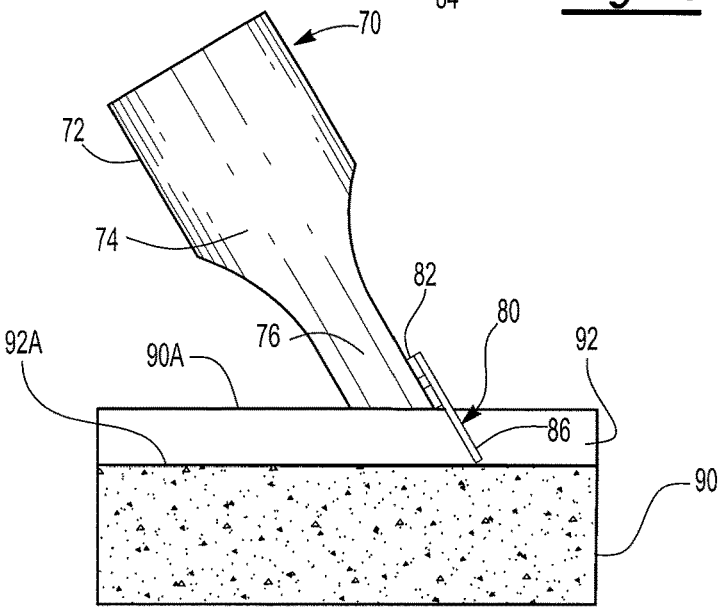
Fig-21

CRACK AND CREVICE CLEANING TOOLS AND ATTACHMENTS THEREFOR

RELATED APPLICATIONS

This application is claiming the benefit, under 35 U.S.C. § 119 (e), of the provisional application filed May 16, 2014 under 35 U.S.C. § 111 (b), which was granted Ser. No. 61/994,304 and a second provisional application filed Feb. 20, 2015 under 35 U.S.C. § 111 (b), which was granted Ser. No. 62/118,725. These provisional applications are hereby incorporated by reference in their entireties.

FIELD OF THE INVENTION

The present invention relates to the cleaning of cracks and crevices which may occur in construction or tiling jobs. More particularly, the present invention relates to tools used for crack and crevice cleaning. Most particularly, the present invention relates to improved crack and crevice cleaning tools and attachments therefor.

BACKGROUND OF THE INVENTION

It is well known in the art that cracks and crevices occur in many fields of endeavor, whether intentionally or unintentionally. For example, cracks may appear in concrete surface construction such as sidewalks, driveways, and the like. Often times it is desired to fill in these cracks with a sealant, but many times there is debris which must be removed from the cracks before this can be done. The prior art devices for doing these are various sizes of crevice cleaning tools which are connected to a vacuum source, and held over the crack as best they can be. However, there are no means to guide the crack and crevice cleaning tools while they are doing the job, and many times it is not held in the optimum position.

The same problem can be found for example, in the laying of ceramic tile or other floor tiles. These are installed on mastic or cement and may have spaces in between if ceramic tile is involved. The grout is then put between the cracks. However, it is desired to clean out any foreign material before the grout is applied. The same problem occurs as described above.

SUMMARY OF THE INVENTION

The problems in the prior art have been solved by the present invention by providing a guide means in the form of a simple attachment for existing crevice tools, or a modified crevice tool.

BRIEF DESCRIPTION OF THE DRAWINGS

The above, as well as other advantages of the present invention will become readily apparent to those skilled in the art from the following detailed description when considered in the light of the accompanying drawings in which:

FIG. 18 is a top plan view of an attachment to be used in connection with the construction shown in FIG. 15.

FIG. 19 is a right end view of the construction shown in FIG. 18.

FIG. 20 is an elevational view of the construction shown in FIG. 18.

FIG. 21 is a diagrammatic view showing the use of the crevice tool illustrated in FIGS. 18-20.

DETAILED DESCRIPTION OF THE PREFERRED EMBODIMENTS

Figure 1:
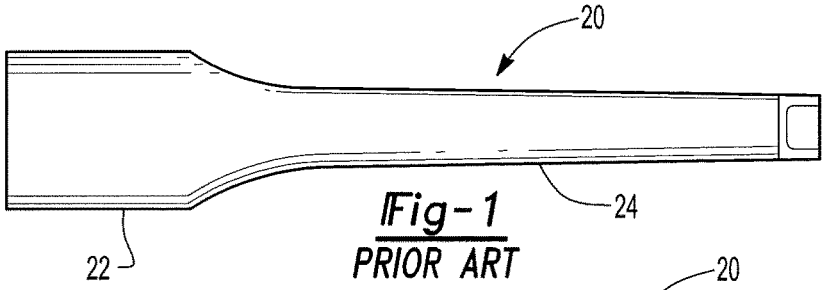
Fig-1 PRIOR ART
FIG. 1 is a top plan view of a first prior art crevice cleaning tool.
Figure 2:
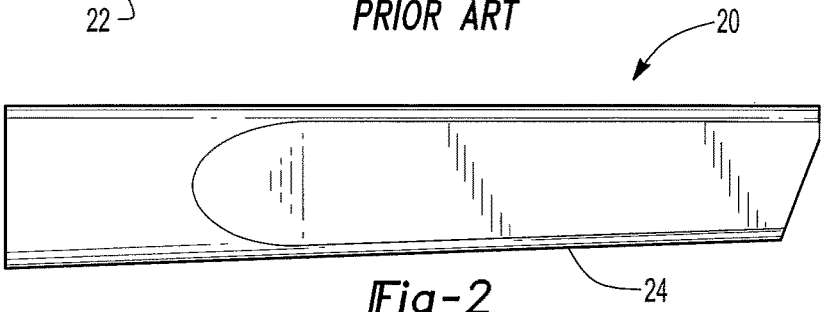
Fig-2 PRIOR ART
FIG. 2 is an elevational view of the construction shown in FIG. 1.
Figure 3:
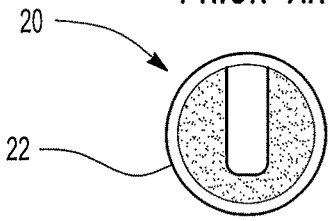
Fig-3 PRIOR ART
FIG. 3 is a left end view of the construction shown in FIG. 1.

Referring to FIGS. 1-3, there is shown a prior art crevice cleaning tool generally designated by the numeral 20. The tool has a portion 22 of circular cross section for attachment to a vacuum cleaner hose or the like, and a flattened or nozzle portion 24 which, in use is placed over the crack or crevice it is desired to clean.

Figure 4:
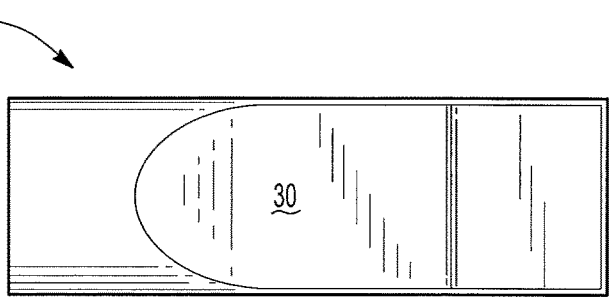
Fig-4 PRIOR ART
FIG. 4 is a top plan view of a second prior art crevice cleaning tool.
Figure 5:
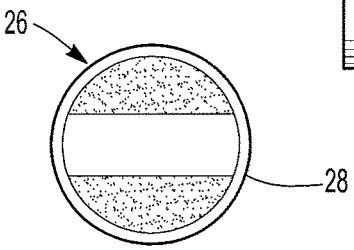
Fig-5 PRIOR ART
FIG. 5 is an elevational view of the construction shown in FIG. 4.
Figure 6:
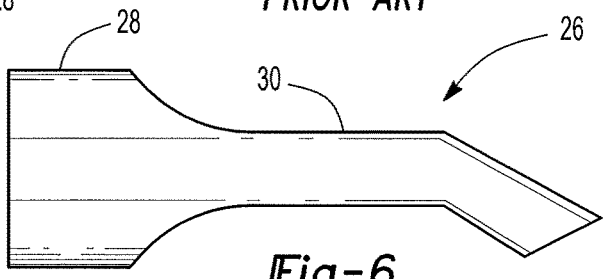
Fig-6 PRIOR ART
FIG. 6 is a right end view of the construction shown in FIG. 4.

Referring now to FIGS. 4-6, there is shown another prior art crevice cleaning tool, generally designated by the numeral 26. As with the construction shown in FIG. 1-3, this prior art crack and crevice cleaning tool, generally designated by the numeral 26, has a portion of circular cross section 28 for attachment to a vacuum hose or the like and a flattened or nozzle portion 30 to be placed over the crack or crevice it is desired to clean.

The problem with these prior art cleaning tools is that in use it is difficult to hold them in a desired position over the crack or crevice to be cleaned, as there is no guidance, and the cleaning depends upon the steady hand of the operator.

Figure 7:
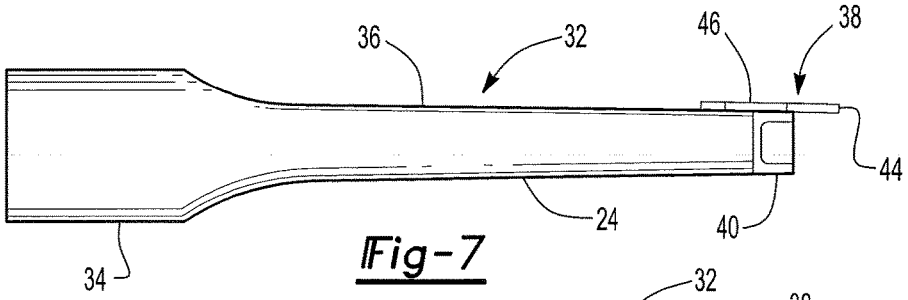
FIG. 7 is a top plan view of a construction embodying the present invention.
Figure 8:
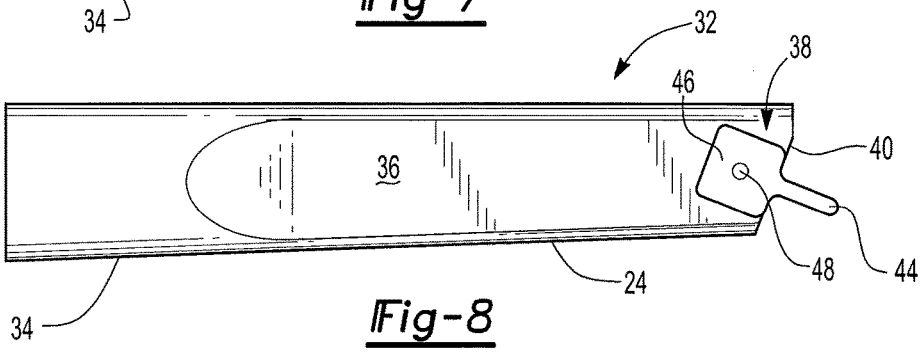
FIG. 8 is an elevational view of the construction shown in FIG. 7.
Figure 9:
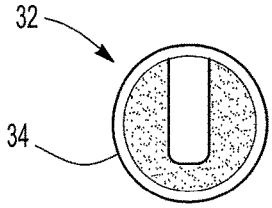
FIG. 9 is a right end view of the construction shown in FIG. 7.

This problem in the prior art is solved by the construction shown in FIGS. 7-14. Referring first to FIGS. 7-9, there is shown an improved crack or crevice cleaning tool embodying the present invention. This tool may be, but need not be, similar in part to the prior art tool described in FIGS. 1-3, and is designated by the numeral 32 to distinguish it from the prior art tool, but like the prior art tool, it has a portion 34 of circular cross section for attachment to a vacuum hose or the like, and a flattened or nozzle portion 36

Figure 10:
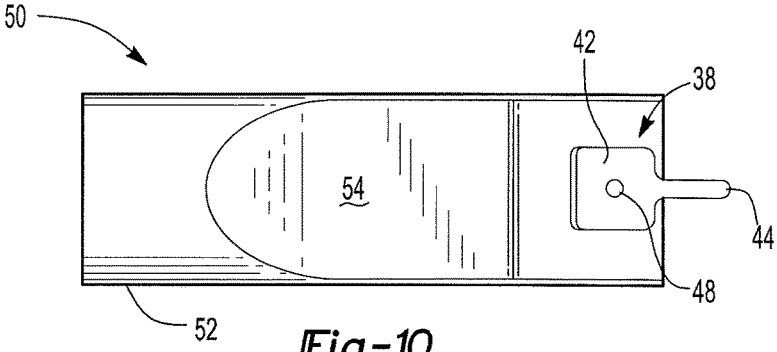
FIG. 10 is a top plan view of a construction embodying a modification of the present invention.
Figure 12:
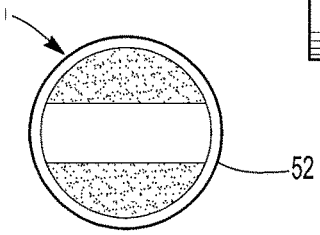
FIG. 12 is a right end view of the construction shown in FIG. 10.
Figure 11:
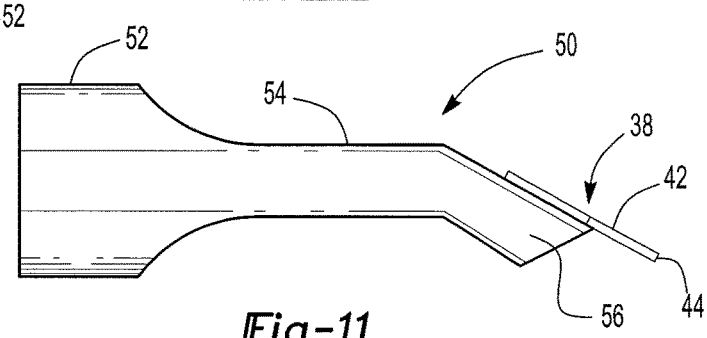
FIG. 11 is an elevational view of the construction shown in FIG. 10.
Figure 13:
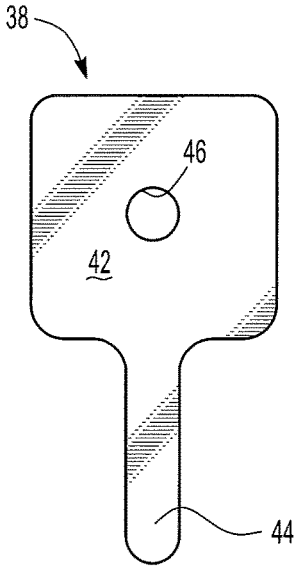
FIG. 13 is a top plan view of an attachment for crevice and crack cleaning tools embodying the present invention.
Figure 14:
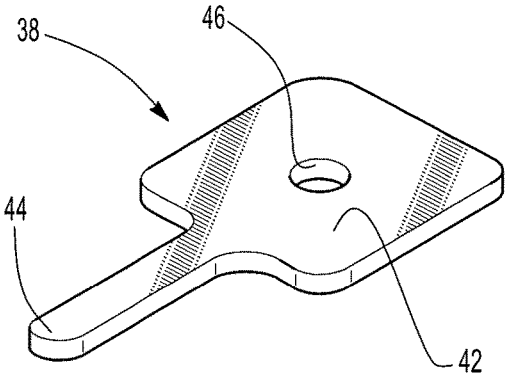
FIG. 14 is a perspective view of the construction shown in FIG. 13.
Figure 17:
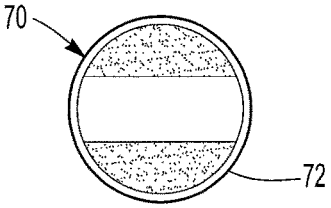
FIG. 17 is a right end view of the construction shown in FIG. 15.
Figure 15:
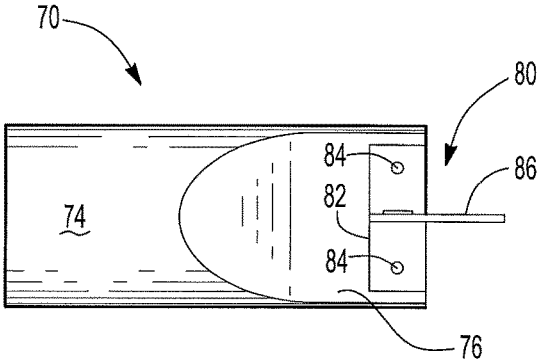
FIG. 15 is a top plan view of a construction embodying a modification of the present invention.
Figure 16:
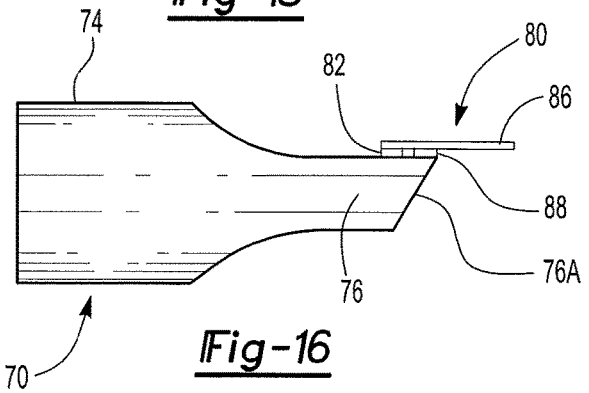
FIG. 16 is an elevational view of the construction shown in FIG. 15.

Referring now to FIGS. 10-12, there is shown an improved crack or crevice cleaning tool embodying a modification of the present invention. This tool may be, but need not be, largely same as the prior art tool just described with regard to FIGS. 4-6, and is designated by the numeral 50 to distinguish it from the prior art tool, but like the prior art tool, it may have a portion of circular cross section 52 for attachment to the vacuum hose or the like, and a nozzle portion 54.

Guide means, generally indicated by the numeral 38, are provided and are either fixedly formed at the end 56 of the nozzle portion 54 or rotatably attached so it may be moved out of the way when not needed. The guide means 38 may have a head or enlarged portion 42, and an elongated portion 44.

If it is desired to rotatably mount the guide means 38 to the end 56 of the nozzle portion 54 an aperture 46 (FIGS. 13-14) is provided, through which a fastening means 48 may be passed.

Referring to FIGS. 15-20, there is shown a further modification of the present invention. This larger or more robust tool is referred to by the numeral 70 to distinguish it from the earlier modifications. It has a round portion 72 for attachment to a cleaning hose, a body portion 74 and a nozzle portion 76. Attached proximate the bottom of the nozzle portion 76 is a fixed guide means 80.

The guide means 80 has a base portion 82 having a plurality of apertures 84 for mounting the fixed guide means 80 to the nozzle portion 76 of the tool 70. It also has an extension or rod-like portion 86 fixedly mounted proximate the center of the base portion 82. The base portion 82 of the fixed guide means 80 is mounted to the nozzle portion 76 of the large crevice tool 70 such that at least one side 88 of base portion. 82 is parallel to, and proximate the end 76A of the nozzle 76.

Referring to FIG. 21, there is shown a broken away sectional view of a construction 90 having a crevice or crack 92 out of which debris must be cleaned by the large crevice cleaning tool 70. The rod-like portion 86 of the tool 70 extends down toward the bottom of the crack 92A, but, preferably will not touch it. It normally acts solely as a guide means.

The bottom portion 88 of base portion 82 which is proximate the nozzle portion 76 of the tool 70 is riding on the top 90A of the construction 90, and is taking any wear that is occurring to the large tool 70, by acting as a wear plate It should be understood that the FIG. 21 is just merely a diagrammatic representation of how the tool may be used and should not be considered limiting in any fashion.

In accordance with the provisions of the patent statutes, the present invention has been described in what is considered to represent its preferred embodiments. However, it should be noted that the invention can be practiced otherwise than as specifically illustrated and described without departing from its spirit or scope.

What is claimed:

1. An improved crack and crevice cleaning tool comprising:

a) a portion of circular cross section for attachment to a source of vacuum, b) a flattened or nozzle portion for placement next to a crack or crevice, and;

c) means for guiding the crack and crevice cleaning tool mounted at the end of the nozzle portion, wherein the means for guiding the crack and crevice cleaning tool is mounted externally on and parallel to the nozzle portion, and the means for guiding the crack and crevice tool further comprises:

a head portion, and;

an elongated portion, wherein the elongated portion is configured to extend into a crack or crevice and to guide the crack and crevice cleaning tool.

2. The improved crack and crevice cleaning tool defined in claim 1, wherein the means for guiding the crack and crevice cleaning tool is fixedly mounted to the end of the nozzle portion.

3. The improved crack and crevice cleaning tool defined in claim 1, wherein the means for guiding the crack and crevice cleaning tool is configured to displace debris to be removed.

* * * * *